SR
5/24/77 XR 4,024,720

United States Patent [19]
Dimentberg, deceased et al. No Bandles
[11] 4,024,720
[45] May 24, 1977

[54] TRANSPORTATION OF LIQUIDS

[76] Inventors: Moses Dimentberg, deceased, late of Winnipeg, Canada; by Myer Dimentberg, executor, 5830 Wolsely Ave., Cote St. Luc, Quebec, Canada.

[22] Filed: Apr. 4, 1975

[21] Appl. No.: 564,869

[52] U.S. Cl. ..... 62/55; 137/13; 137/14

[51] Int. Cl.[2] ..... F17C 7/02

[58] Field of Search ..... 62/55; 137/13, 14

[56] References Cited

UNITED STATES PATENTS 2,958,205 11/1960 McConkey ..... 62/55 X
3,256,705 6/1966 Dimentberg ..... 62/55

*Primary Examiner*—Ronald C. Capossela
*Attorney, Agent, or Firm*—Stanley G. Ade

[57] ABSTRACT

Low temperature liquefied gases such as natural gas are usually transported at temperatures of approximately −258° F and at atmospheric pressures. If it is desired to transfer such liquids in pipelines, high cost materials must be used in pipeline construction and high contraction stresses are encountered requiring incorporation of contraction loops and bellows. Considerable savings will occur if the pipeline operates at intermediate temperatures of between − ° and −120° F and at a pressure sufficient to maintain the liquid phase within this temperature range. This permits lower cost materials to be used in the pipeline construction and eliminates the necessity of contraction loops and bellows.

11 Claims, 2 Drawing Figures

TRANSPORTATION OF LIQUIDS

BACKGROUND OF THE INVENTION

This invention relates to new and useful improvements in the transmission of low temperature liquids such as liquefied natural gas (L.N.G.) and the like.

There is at present a relatively large and growing international trade in liquefied natural gas wherein the gas is carried in ocean going tankers from producing countries such as Algeria, to consuming countries such as France, Great Britain and the U.S.A.

The temperature of the liquefied natural gas in this transportation system is approximately −258°F since at this termperature, the liquefied natural gas (which consists mainly of methane) has a saturation pressure corresponding to atmospheric pressure.

Because of this, ship liquid natural gas containers and the large storage tanks required at the shipping and receiving ports, are constructed of relatively light gauge materials and in connection with the present invention, it should be noted that intermediate liquefied natural gas temperatures of say between −180° to −130° F, would result in correspondingly higher container pressures in the neighborhood of 190 P.S.I. to 530 P.S.I. which would, of course, necessitate heavier and more expensive pressure vessels for storage and transportation.

Present practice is to regassify the liquefied natural gas at the seaport and feed it directly to distribution mains or into vapor phase transmission pipelines for delivery to inland markets.

Several studies have been performed and published wherein liquefied natural gas was considered to be transformed to liquefied natural gas pipelines for the purpose of supplying inland markets and these studies have been based upon receiving the L.N.G. at the inlet to the transmission pipelines at the aforementioned low temperature of −258°F. The results of such studies have been that low temperature L.N.G. pipelines would be marginally competitive with present vapor phase pipelines and they would also, of course, be subjected to high contractions stresses due to cool-down from initially ambient temperatures to the low operative temperatures which would exist. Because of this, contraction loops or bellow would most likely be required resulting in additional complications and expense. Furthermore, since much of the pipeline will be operated at low temperatures (−258° F approximately), relatively expensive low temperature materials such as 9% nickel steel and aluminum alloys would be required.

SUMMARY OF THE INVENTION

Considerable savings will be achieved by designing L.N.G. pipelines to operate at intermediate temperatures (−200° F to −120° F) so that pipeline materials such as 1% and 3½% nickel steel may be used thus resulting in considerable lower costs. Furthermore, using intermediate temperatures such as those mentioned, contraction stresses within the pipeline may be maintained within safe limits thus eliminating the requirement for such devices as contraction loops and bellows.

The principal object and essence of the invention is therefore to provide a method whereby low temperature liquids may be transported within pipelines within an intermediate temperature range of approximately −200°F to −120°F.

Another object of the invention is to provide a method of the character herewithin described which includes pumping and cooling stations along the length of the pipeline to maintain the temperature and pressure of the liquid within ranges which will prevent vaporization of the liquid from occurring.

Another object of the invention is to provide a method of the character herewithin described in which the pipeline normally would be insulated, but in which the last portion of the pipeline may be uninsulated thus permitting vaporization of the liquid to occur within the last section so that it is ready for entry into a conventional gas pipeline.

A still further object of the invention is to provide a method of the character herewithin described which will result in considerable economy in the transportation and storage of low temperature liquids, which is simple in construction, and which is well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DETAILED DESCRIPTION

Figure 1:
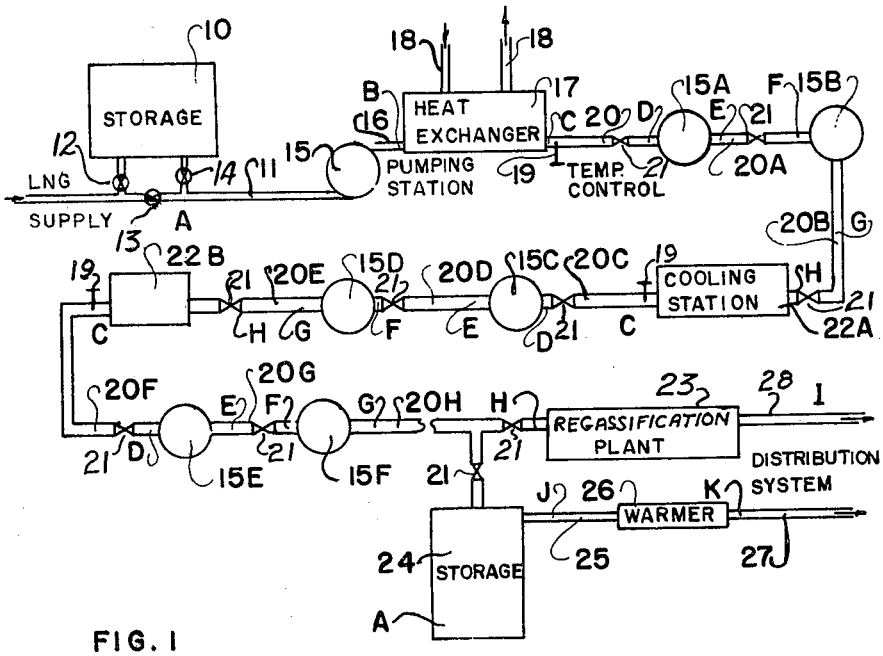
FIG. 1 is a schematic view of a pipeline system utilizing the invention.

Although the present invention is directed primarily to the transmission of liquefied natural gas, nevertheless it will be appreciated that other low temperature liquids may be transmitted by a similar method.

Furthermore, because the major constituent of L.N.G. is methane, the properties of methane have been assumed in the following description.

Proceeding therefore to describe the inventon in detail, L.N.G. at approximately −258° F and atmospheric pressure is received from the L.N.G. supply system or storage tanks 10 and is fed into the transfer pipeline 11, the control of the supply being by means of valves 12, 13 and 14.

Transfer pipeline 11 connects with a pumping station 15 where the pressure of the L.N.G. is increased from atomospheric pressure to the desired pressure, the desired pressure being selected on the basis of the conditions and requirements of each individual installation. However, it will be in the neighborhood of 500 P.S.I. and this pressure must be sufficiently high to ensure liquid flow can be maintained along the entire pipeline system.

A connecting pipe 16 extends from the pumping station 15 to a heat exchanger 17 which is conventional in construction. The L.N.G. is warmed to the desired temperature by a warming fluid which is circulated through pipes 18 and a conventional temperature control 19 is provided to regulate the flow of warming fluid to ensure that the desired temperature of the L.N.G. is achieved.

This temperataure is selected to permit the use of lower cost pipeline materials such as 3½% or 1% nickel steel, and to reduce contraction stresses due to cool-down, to acceptable levels. It has been found that a satisfactory temperature for this purpose is −150° F, although the optimum temperature for each installation will, of course, be controlled by the overall conditions which exist. However, it will be appreciated that a certain range of temperatures can be utilized and it has been found that this range should be between −200° and −120° F.

The liquefied natural gas will flow out of the heat exchanger 17 into a first L.N.G. pipeline section 20 which may be as much as 25 miles in length. A back pressure valve 21 is located at the downstream end of the pipeline section 20 and is set so that the pressure at this point is above the saturation pressure corresponding to the L.N.G. temperature. In a relatively long pipeline, pumping stations 15A, 15B, etc., are employed periodically to raise the pressure of the L.N.G. in order to force it through each succeeding pipeline section 20A, 20B, 20C, etc., and it is desirable that the length of each pipeline section be approximately equal.

The pipeline sections should, of course, be insulated in order to reduce heat infiltration although even so, as the L.N.G. flows along the pipeline, the temperature thereof increases because of some heat infiltration and because of frictional heating.

Cooling stations 22A, 22B, etc., are therefore provided and regulated by temperature controls 19 in order to remove the heat and to lower the L.N.G. temperature in order to prevent boiling of the L.N.G. within the pipeline. As the construction of such cooling stations is well-known, it is not believed necessary to explain the construction thereof in this application.

The L.N.G. may be delivered directly to the distribution system through a regassification plant 23 at the downstream end of the pipeline or it may be delivered to a storage facility 24 through back-check valve 21 as shown schematically in FIG. 1. The storage facility 16 should be operated at −258° F and at atmospheric pressure so that the introduction of L.N.G. to the storage facility will be accompanied by the vaporization of a portion may be drawn off through a pipe or conduit 25, passed through a warming device 26 prior to being sent to the distribution system through pipe 27.

The above description deals with a relatively long L.N.G. pipeline which may be several hundred miles in length, but it is evident in many instances, much shorter pipelines will be needed so that pumping stations 15A, etc., and cooling stations 22A, etc., will not be required.

In cases where delivery is to be made directly to a natural gas distribution system through pipe 28, for example, it is possible to eliminate all or a portion of the insulation on the last pipeline section 20, and to permit gassification to take place within this section thus eliminating the regassification plant 23. However, the decision whether to choose this alternative will depend upon the relative costs of gassification, insulation and pipe materials.

Figure 2:
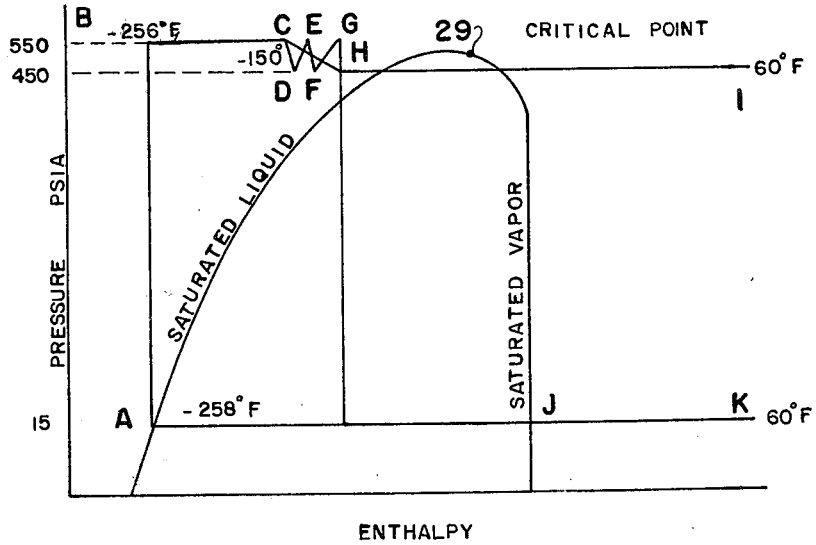
FIG. 2 is a pressure-enthalpy diagram for liquefied natural gas indicating the state of the product at each stage in the system described in FIG. 1.

Reference to FIG. 2 will show the state of the product at each stage in the system hereinbefore described, the corresponding indicia A, B, C., etc., being shown in both FIGS. 1 and 2 and it will be observed that it is necessary to maintain the liquefied natural gas below the saturation temperature and within the desired pressure range, the critical point being illustrated in FIG. 2 by reference character 29.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. The method of transporting low temperature liquids such as liquefied natural gas and the like, from a supply point by passing the liquid stream through a pumping station where the pressure of said liquid is raised and then passing the liquid through a heat exchanger where the temperature of said liquid is raised to a value in the range of between −200° F and −120° F, and then passing said liquid through insulated transportation pipeline and maintaining a pressure within the transmission pipeline sufficiently high to maintain said liquid in the said range.

2. The method according to claim 1 in which the liquid being transmitted is liquefied natural gas.

3. The method according to claim 2 in which the transmission pipeline consists of a plurality of sections of substantially equal lengths and which includes the step of increasing the said pressure of the liquid adjacent the inlet end of each section sufficiently to maintain the liquid in the liquid phase and prevent vaporization of said liquid from occurring.

4. The method according to claim 3 which includes the additional step of cooling the liquid at intervals along said pipeline wherein heat is removed from the low temperature liquid to reduce the temperature thereof to a value equal to or higher than the temperature of the liquid upon the entry of said liquid into the initial pipeline section.

5. The method according to claim 3 in which at least a portion of the downstream end of the last pipeline section is not insulated and which includes the step of permitting vaporization of the liquid to occur within said last mentioned pipeline section.

6. The method according to claim 2 which includes the additional step of cooling the liquid at intervals along said pipeline wherein heat is removed from the low temperature liquid to reduce the temperature thereof to a value equal to or higher than the temperature of the liquid upon the entry of said liquid into the initial pipeline section.

7. The method according to claim 1 in which the transmission pipeline consist of a plurality of sections of substantially equal lengths and which includes the step of increasing the said pressure of the liquid adjacent the inlet end of each section sufficiently to maintain the liquid in the liquid phase and prevent vaporization of said liquid from occurring.

8. The method according to claim 7 which includes the additional step of cooling the liquid at intervals along said pipeline wherein heat is removed from the low temperature liquid to reduce the temperature thereof to a value equal to or higher than the temperature of the liquid upon the entry of said liquid into the initial pipeline section.

9. The method according to claim 8 in which at least a portion of the downstream end of the last pipeline section is not insulated and which includes the step of permitting vaporization of the liquid to occur within said last mentioned pipeline section.

10. The method according to claim 1 which includes the additional step of cooling the liquid at intervals along said pipeline wherein heat is removed from the low temperature liquid to reduce the temperature thereof to a value equal to or higher than the temperature of the liquid upon the entry of said liquid into the initial pipeline section.

11. The method according to claim 1 in which at least a portion of the downstream end of the last pipeline section is not insulated and which includes the step of permitting vaporization of the liquid to occur within said last mentioned pipeline section.

* * * * *